United States Patent [19]

Klemp

[11] Patent Number: 4,679,884

[45] Date of Patent: Jul. 14, 1987

[54] FUSED ELECTRICAL PLUG

[75] Inventor: Eldon J. Klemp, Mayer, Minn.

[73] Assignee: Litton Systems, Inc., Beverly Hills, Calif.

[21] Appl. No.: 860,440

[22] Filed: May 7, 1986

[51] Int. Cl.[4] ..... H01R 13/68

[52] U.S. Cl. ..... 439/106; 337/198; 439/596; 439/622

[58] Field of Search ..... 339/147 P, 196 R, 196 A, 339/196 M, 63 R, 63 M; 337/197, 198, 201, 214, 264

[56] References Cited

U.S. PATENT DOCUMENTS

| | | | |
|---|---|---|---|
| 2,705,309 | 3/1955 | Bramming | 339/196 R |
| 4,418,978 | 12/1983 | Shamir | 339/147 P |

FOREIGN PATENT DOCUMENTS

| | | | |
|---|---|---|---|
| 624160 | 12/1935 | Fed. Rep. of Germany | 337/198 |
| 2065990 | 7/1981 | United Kingdom | 339/147 P |

OTHER PUBLICATIONS

European Electronic Cords Design Chart by J. Phillip Industries, Inc.

*Primary Examiner*—Gil Weidenfeld
*Assistant Examiner*—Gary F. Paumen
*Attorney, Agent, or Firm*—John M. Haurykiewicz; Walter R. Thiel

[57] ABSTRACT

A fused electrical plug for interconnecting appliances with a power supply (such as a conventional wall outlet). The plug includes at least neutral and positive terminal posts and may includes a ground terminal. The plug also includes a first body portion from which the neutral terminal post extends, the first body portion including a cavity for receiving a fuse. A second plug body portion carries the positive terminal post while a hinge secures the first and second plug portions for pivotal relative movement between an open position wherein the fuse receiving cavity is accessible in a closed position wherein the fuse receiving cavity is inaccessible. Electrical communication to the appliance is established via a fuse within the cavity and the positive terminal only when the first and second body portions are in the closed position. In a preferred embodiment, the first and second plug body portions are molded with the hinge being formed as a living hinge.

11 Claims, 4 Drawing Figures

FUSED ELECTRICAL PLUG

BACKGROUND OF THE INVENTION

1. Field of the Invention

Appliances of many descriptions are known to the prior art. Of these, many are stationary and permanently connected to a power supply. Others, however, are portable (in the sense that they may be moved) with their movement being accommodated by a plug/outlet interconnection between the appliance and the power supply. The present invention provides an improved plug for interconnection to a power supply.

2. Description of the Prior Art

Government regulations and/or operating safety of an appliance often require a fuse which is dedicated to that appliance and independent of the line fuses of the power supply. Typically, such fuses are contained within the appliance. As a result, fuse replacement often requires servicing by a trained technician. In some instances, this is intentional.

In those instances where it is desirable or appropriate to allow consumer servicing of an appliance fuse, the placement of that fuse within the appliance housing requires an unnecessarily cumbersome operation. Among the approaches to facilitate fuse servicing, without access to the appliance housing, are the utilization of a fuse holder within the appliance power cord. Such holders are readily accessible without dismantling the appliance housing. A variation on this approach is the placement of a fuse within the appliance plug, the appliance plug being adapted for insertion in a conventional outlet of any known design. However, both of these approaches may frustrate the purpose of the fuse itself.

Particularly with a line fuse, within the power cord, a shorting device may be easily inserted thereby eliminating the safety factor provided by the fuse. With both the line fuse and those known appliance plugs having provision for a fuse, the plugs may be inserted within an electrical outlet, with or without a fuse in position. The result of these known prior art appliance fusing approaches is to place the fuse within the appliance housing in those instances where fuse tampering is particularly sensitive. Large appliances are examples of devices wherein this approach has been adopted.

SUMMARY OF THE INVENTION

The present invention provides a fused electrical plug that may be employed with appliances of known design and in which the fuse is readily accessible for consumer servicing while frustrating attempts to reconnect the plug to a power supply if servicing has not been properly accomplished. A plug in accordance with the present invention includes at least neutral and positive terminal posts with the neutral terminal extending from a first plug body portion. The first plug body portion includes a cavity for receiving a fuse and is hinged to a second plug body portion from which the positive terminal post extends. Through the action of the hinge, the first and second plug body portions are pivotable relative to each other between an open position wherein the fuse receiving cavity is accessible and a closed position wherein the fuse receiving cavity is inaccessible. Electrical communication via a fuse within the cavity and the positive terminal is established only when the first and second plug body portions are in the closed position.

In a preferred embodiment, the first and second plug body portions are molded with the hinge being formed as a living hinge. Means are provided to releasably secure the first and second body portions in the closed position and may include a recess within a surface of one of the body portions and a flange carrying a rib extending from the other body portion. The rib lies within the recess when the first and second plug body portions are in the closed position. Electrical communication with the fuse may be established by fuse clips. In a preferred embodiment, a fuse clip is molded into each of the first and second body portions such that electrical communication between an appliance to be powered and the positive terminal post of the plug is established only when the two body portions are in the closed position.

DETAILED DESCRIPTION OF THE PREFERRED EMBODIMENTS

Figure 1:
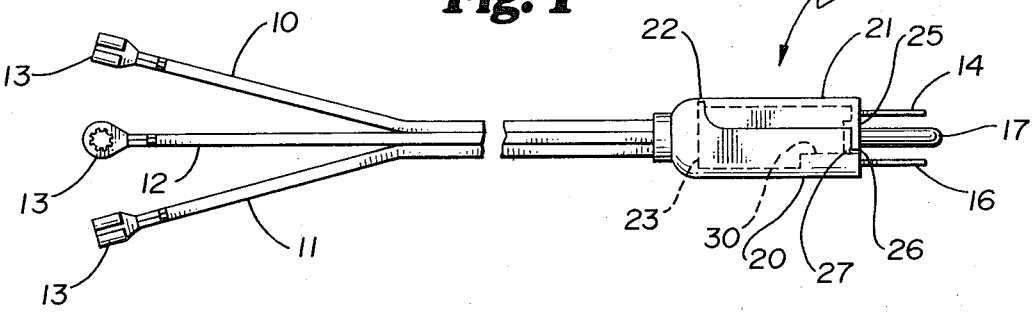
FIG. 1 is a side view of an appliance cord employing a fused plug in accordance with the present invention, the plug being in a "closed" condition in FIG. 1.

FIG. 1 illustrates an appliance cord in accordance with the present invention including electrical conductors 10–12 each of which are of conventional design and which terminate at one end in terminals 13 which are adapted for connection to the power input terminals of an appliance. In the illustrated embodiment, the conductor 10 is a positive conductor which is connected, in a manner described more fully below, to a positive terminal post 14 extending from a plug body, the plug body being designated generally at 15. A neutral conductor 11 is connected, via the plug 15, to a neutral or common terminal post 16 while the ground conductor 12 is connected to a ground terminal post 17. Interconnection between the conductors 11 and 12 and the terminal posts 16 and 17, respectively, is accomplished within the plug body 15 in any conventional and desired manner.

The plug body 15 is formed of two parts, a first body portion 20 (from which the neutral terminal 16 and ground terminal 17 extend) and a second body portion 21 (from which the positive terminal 14 extends). The body portions 20 and 21 which form the plug 15 may be of a molded construction hinged to each other for relative pivotal movement as at 22. The hinge connection 22 may be formed as a web of material integral with and extending between the body portions 20 and 21, and which is commonly known as a "living hinge." At least the first body portion 20 of plug 15 includes a recess represented by a dotted line 23, the recess being adapted to accept a fuse in a manner described more fully below.

Figure 2:
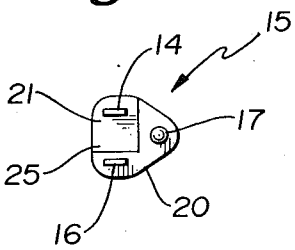
FIG. 2 is an end view of a plug in accordance with the present invention in the closed condition illustrated in FIG. 1.
Figure 3:
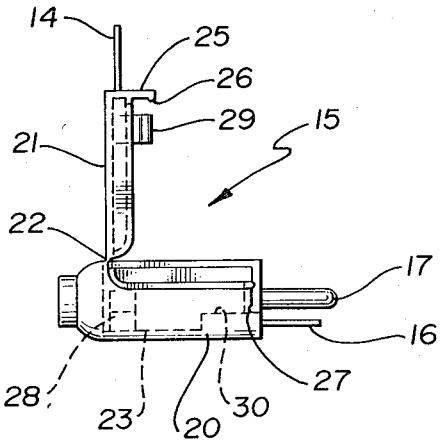
FIG. 3 is a side view of the plug of FIGS. 1 and 2 in a "open" condition.
Figure 4:
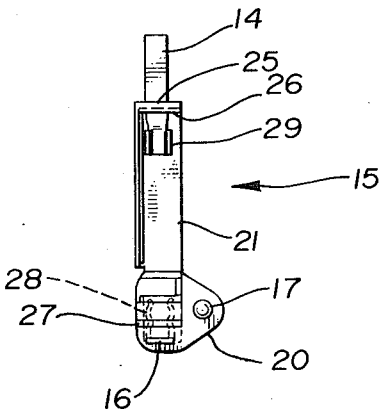
FIG. 4 is an end view of a plug in accordance with the present invention in the open condition illustrated in FIG. 3.

FIGS. 1 and 2 illustrate the body portions 20 and 21 of plug 15 in a closed relative position or condition while FIGS. 3 and 4 illustrate those body portions in an open position. As illustrated, in the closed position of FIGS. 1 and 2, the recess (represented by the dotted line 23) is inaccessible while that recess is freely accessible in the open position illustrated in FIGS. 3 and 4. A flange 25 extends from body portion 21 and terminates at a rib 26. A recess 27 is provided in a surface of the body 20 and is positioned to accept the rib 26 of the flange 25 when the body portions 20 and 21 are in the closed position of FIGS. 1 and 2. In that closed position, the flange 25 extends over a portion of the surface of the body 20 to extend the rib 26 to the recess 27. Cooperation between the rib 26 and recess 27 acts to secure the body portions 20 and 21 in the closed position. In the closed position, the terminals 14, 16 and 17 of plug 15 are oriented in conformity with an outlet of conventional design.

As described to this point, the terminals 16 and 17 are connected to their associated conductors 11 and 12 in any conventional manner within the body portion 20. However, terminal 14 is interconnected to the conductor 10 via a fuse to be positioned within the cavity in body portion 20 (outlined by dotted line 23). For this purpose, a fuse clip 28, of conventional design, is positioned within the cavity of body portion 20 and electrically connected to the conductor 10 in any desired manner. Similarly, a fuse clip 29, also of conventional design, is carried by the body portion 21 and in electrical communication with the terminal post 14. Thus, a fuse extending between the clips 28 and 29 will establish electrical communication between the terminal post 14 and conductor 10 and, via that communication, between the post 14 and the appliance to be powered. As will be readily apparent to those familiar with the art, the fuse may be positioned within the clip 28 and within the recess of body portion 20 to rest atop a positioning shoulder 30 within the recess. A closing of the body 21 relative to the body 20 (by pivotal motion around the hinge 22) will cause the clip 29 to engage a fuse resting atop the shoulder 30. Complete closing of the body members 20 and 21, relative to each other, will establish electrical communication between the clips 28 and 29 via the fuse, in known manner.

Obviously, many modifications and variations of the present invention are possible in light of the above teachings. For example, an appliance plug in accordance with the present invention may be constructed with only a neutral or common terminal post and a positive terminal post and without a grounded post. Alternatively, the illustrated terminal post may be sized and oriented relative to each other in accordance with the configuration of the outlet it is designed to mate with. It is therefore to be understood that, within the scope of the appended claims, the invention may be practiced otherwise than as specifically described.

What is claimed is:

1. A fused electrical appliance plug including at least neutral and positive terminal posts and further comprising:

a first plug portion from which said neutral terminal post extends along an axis parallel to the principal axis of said first plug body portion, said first plug body portion including a cavity for receiving a fuse;

a second plug body portion from which said positive terminal post extends;

hinge means securing said first and second plug body portions for pivotal relative movement between an open position wherein said fuse receiving cavity is accessible and a closed position wherein said fuse receiving cavity is inaccessible;

means for (i) mechanically positively retaining a fuse on said second plug body portion while said second body portion is in said open position, and (ii) establishing an electrical connection through said fuse in said cavity between a cord conductor and said positive terminal post only when said first and second plug body portions are in said closed position and along an axis parallel to the principal axis of said first plug body portion; and means for releasably securing said first and second plug body portions in said closed position wherein the initial pivoting movement upon opening said first and second plug body portions is substantially perpendicular to the axis of said positive terminal post.

2. The electrical appliance plug of claim 1 wherein said first and second plug body portions are molded, said hinge means comprising living hinge means.

3. The electrical appliance plug of claim 2 further comprising a grounded terminal post extending from said first plug body portion.

4. The electrical appliance plug of claim 1 wherein said electrical connection establishing means comprises first fuse clip means carried by said first plug body portion within said cavity and second fuse clip means carried by said second plug body portion.

5. The electrical appliance plug of claim 4 wherein said first and second plug body portions are molded, said terminal posts and said fuse clips being molded in place in their respective plug body portions.

6. The electrical appliance plug of claim 5 wherein said hinge means comprises living hinge means.

7. The electrical appliance plug of claim 1 wherein said releasably securing means comprises a recess in a surface of one of said plug body portions and a flange including a rib means extending from the other of said plug body portions and overlying said one plug body portion surface with said rib means within said recess means when said first and second plug body portions are in said closed position.

8. The electrical appliance plug of claim 7 wherein said electrical connection establishing means comprises first fuse clip means carried by said first plug body portion within said cavity and second fuse clip means carried by said second plug body portion.

9. The electrical appliance plug of claim 8 wherein said first and second plug body portions are molded, said terminal posts and said fuse clips being molded in place in their respective plug body portions.

10. The electrical appliance plug of claim 9 wherein said hinge means comprises living hinge means.

11. The electrical appliance plug of claim 10 further comprising a grounded terminal post extending from said first plug body portion.

* * * * *